US009322608B2

(12) United States Patent
Painter

(10) Patent No.: US 9,322,608 B2
(45) Date of Patent: Apr. 26, 2016

(54) ARCHERY BOW AND METHOD FOR ASSEMBLY THEREOF

(71) Applicant: Tribe Archery, LLC, Dayton, OH (US)

(72) Inventor: Heath Jeremy Painter, Waynesville, OH (US)

(73) Assignee: TRIBE ARCHERY, LLC, Dayton, OH (US)

( * ) Notice: Subject to any disclaimer, the term of this patent is extended or adjusted under 35 U.S.C. 154(b) by 0 days.

(21) Appl. No.: 14/330,501

(22) Filed: Jul. 14, 2014

(65) Prior Publication Data

US 2016/0010942 A1 Jan. 14, 2016

(51) Int. Cl.
*F41B 5/00* (2006.01)

(52) U.S. Cl.
CPC ..... *F41B 5/0031* (2013.01); *F41B 5/0052* (2013.01)

(58) Field of Classification Search
CPC ..... F41B 5/00; F41B 5/0005; F41B 5/0026; F41B 5/0052
See application file for complete search history.

(56) References Cited

U.S. PATENT DOCUMENTS

| | | | | |
|---|---|---|---|---|
| 1,709,630 | A | 4/1929 | Rounsevelle | |
| 3,207,146 | A | 9/1965 | Grable | |
| 3,415,240 | A | 12/1968 | Bear | |
| 3,527,196 | A | 9/1970 | Karbo | |
| 3,738,348 | A * | 6/1973 | Karbo | 124/23.1 |
| 3,821,946 | A | 7/1974 | Griggs | |
| 3,942,506 | A | 3/1976 | Izuta | |
| 4,122,821 | A | 10/1978 | Mamo | |
| 4,201,183 | A | 5/1980 | Bodkin | |
| 4,494,521 | A | 1/1985 | Quartino | |
| 4,574,766 | A | 3/1986 | Izuta | |
| 5,099,819 | A | 3/1992 | Simonds et al. | |
| 5,150,699 | A | 9/1992 | Boissevain | |
| 5,231,970 | A | 8/1993 | Ploot et al. | |
| 5,339,790 | A | 8/1994 | Smith | |
| 5,392,756 | A | 2/1995 | Simonds | |
| 5,411,008 | A | 5/1995 | Hsu | |
| 5,501,208 | A | 3/1996 | Simonds | |
| 5,503,135 | A | 4/1996 | Bunk | |
| 5,507,270 | A | 4/1996 | Smith | |
| 5,592,929 | A | 1/1997 | Hoyt | |
| 5,657,739 | A | 8/1997 | Smith | |
| 5,660,158 | A | 8/1997 | Rudolph | |
| 6,024,076 | A | 2/2000 | Laborde et al. | |
| 6,067,974 | A | 5/2000 | Islas | |
| 6,105,564 | A * | 8/2000 | Suppan | 124/23.1 |
| 6,244,259 | B1 | 6/2001 | Adkins | |
| 6,571,785 | B1 | 6/2003 | Choma | |
| 6,698,413 | B1 | 3/2004 | Ecklund | |
| 6,718,962 | B2 | 4/2004 | Adcock | |
| 6,886,549 | B2 | 5/2005 | McPherson | |
| 7,025,051 | B1 | 4/2006 | Gallops, Jr. | |
| 7,334,575 | B2 | 2/2008 | McPherson | |
| 8,069,847 | B2 | 12/2011 | Blosser | |
| 8,347,869 | B2 | 1/2013 | Sims et al. | |
| 8,408,192 | B2 | 4/2013 | McPherson | |
| 8,453,635 | B1 | 6/2013 | McPherson | |
| 2009/0145411 | A1 | 6/2009 | Sims et al. | |
| 2013/0081605 | A1 | 4/2013 | Lee | |

* cited by examiner

*Primary Examiner* — John Ricci
(74) *Attorney, Agent, or Firm* — Thompson Hine LLP

(57) ABSTRACT

Archery bows are described that include a first limb releasably connected to a riser by a fastener; wherein one of the first limb and the riser comprises a first end having a generally V-shaped, elongate mounting section, and the other includes a mounting surface shaped to mate with the generally V-shaped, elongate mounting section.

20 Claims, 6 Drawing Sheets

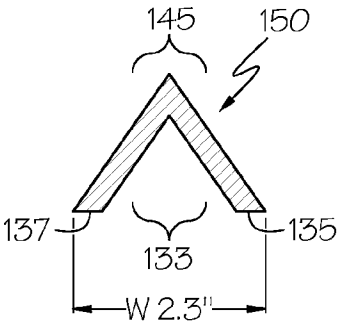
FIG. 6A
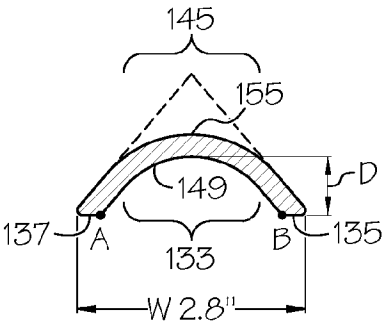
FIG. 6B
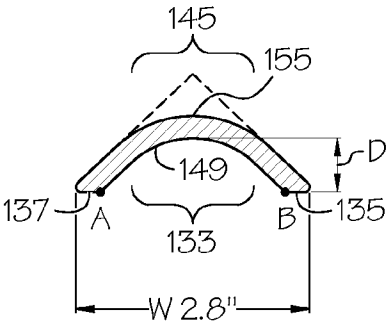
FIG. 6C
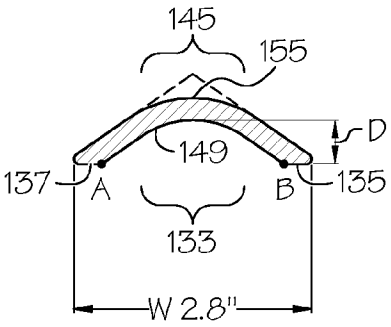
FIG. 6D
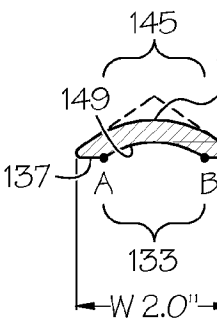
FIG. 6E
FIG. 6F
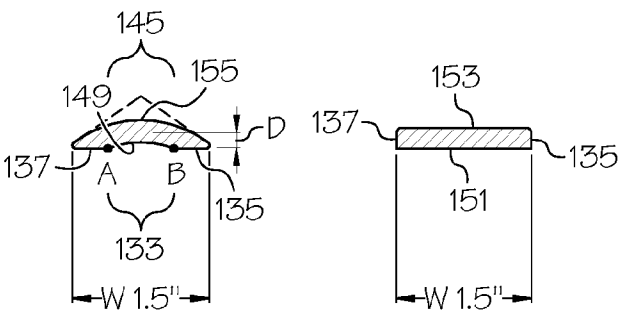
FIG. 6G
FIG. 6H
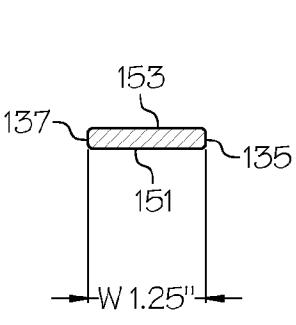
FIG. 6I

ARCHERY BOW AND METHOD FOR ASSEMBLY THEREOF

TECHNICAL FIELD

The present application relates to archery bows, more particularly to recurve archery bows, having a riser releasable connected to two limbs facially mounted to opposing ends of the riser that each include as a mounting face at least two adjacent lateral faces generally oriented as found in a triangular prism.

BACKGROUND

Archery bows typically have a riser portion with a pair of limbs extending from opposed sides or ends of the riser. Limbs of a bow are typically connected to the riser using multiple bolts, screws, or other elongated connection members that extend through the limbs and into the riser, and the point of connection does not generally provide for adequate surface area of contact. Further, stability and performance of the limbs are affected by such connections, thus affecting the flight and accuracy of the arrow.

The performance of an archery bow, measured in terms of accuracy, arrow velocity, and numerous other factors, can be affected by a number of characteristics of the bow, such as weight, bending flex, resiliency, vibration damping, and strength. Arrow velocity is heavily dependent upon the resiliency of a bow, which is a measure of the ability of the bow to recover from a flexed state when the arrow is drawn back. With regard to weight, a lighter bow limb can return faster, resulting in a faster shot. It is therefore important to provide limbs that are both strong and lightweight so that the limbs are able to recover quickly to their original position after they are drawn back and thereafter released.

For recurve archery bows, the further the archer draws the bow string back, the more the resilient limbs of the bow are flexed which imparts a greater amount of stored energy in the bow. When the bowstring is released to shoot the arrow, the resilient limbs of the bow snap back to their original position to force the bowstring back to its initial position to propel the arrow towards a target. Some of the energy is absorbed or transferred into the bow with the excess resulting in a noise. Some of the energy that goes back into the bow returns the bow to its original undrawn state, but much of the energy goes into excessive movement of various bow components resulting in a bow hand shock and system vibrations. Thus, there is a need to reduce the vibration of bow components so that more of the stored energy is transferred into the launching of the arrow.

The accuracy of a bow is another important characteristic. Accuracy is determined by numerous factors. The limbs of the bow must deflect and return on a consistent basis, and the central portion of the bow, the riser, must be sufficiently rigid to not deflect or twist during aiming or shooting. Thus, it is necessary to provide a mounting connection point between the riser and bow limbs that both acts to keep limbs securely in place and also increases surface area of contact.

Accordingly, there is a need for improved archery bow designs.

SUMMARY

In one aspect, archery bows that have a unique connection between the riser and limbs is described. The archery bow includes a first limb releasably connected to the riser by a fastener. Either the first limb or the riser has a first end having a first generally V-shaped, elongate mounting section, and the other includes a first mounting surface shaped to mate and is mated with the first generally V-shaped, elongate mounting section and mounted by the fastener. The archery bow may also include a second limb having the same type of connectivity to the other end of the riser. Whichever of the first limb or the riser has the first mounting surface further includes an angled receiving wall extending from the end of the first mounting surface most proximate a central portion of the first limb or the riser and sloping toward a distal end of the first mounting surface, and the first generally V-shaped, elongate mounting section further comprises a beveled end wall beveled for mating with the angled receiving wall and is mated thereagainst.

In one embodiment, the generally V-shaped, elongate mounting section includes a male connector protruding from an inner surface thereof, and the mounting surface includes a female receptacle having received therein the male connector.

In another aspect, an archery bow kit is disclosed that includes a riser, one or more fasteners and at least a first limb releasably connectable to the riser by at least one fastener. Here, either the first limb or the riser includes a first end having a first generally V-shaped, elongate mounting section, and the other includes a first mounting surface shaped to mate with the first generally V-shaped, elongate mounting section, which are connectable together by the fastener. The kit typically also includes a second limb releasably connectable to the riser by at least one fastener. Here too, either the second limb or the riser includes an end having a second generally V-shaped, elongate mounting section, and the other includes a second mounting surface shaped to mate with the second generally V-shaped, elongate mounting section, which are connectable together by the fastener.

BRIEF DESCRIPTION OF THE DRAWINGS

The claimed subject matter is described with reference to the accompanying drawings. A brief description of each figure is provided below. Elements with the same reference number in each figure indicated identical or functionally similar elements.

FIGS. 6A-6I are transverse cross-sectional views, relative to the longitudinal axis, of the limb in FIG. 2 a bottom plan view looking to the right relative to the orientation of FIG. 1 to the page.

DETAILED DESCRIPTION

Figure 1:
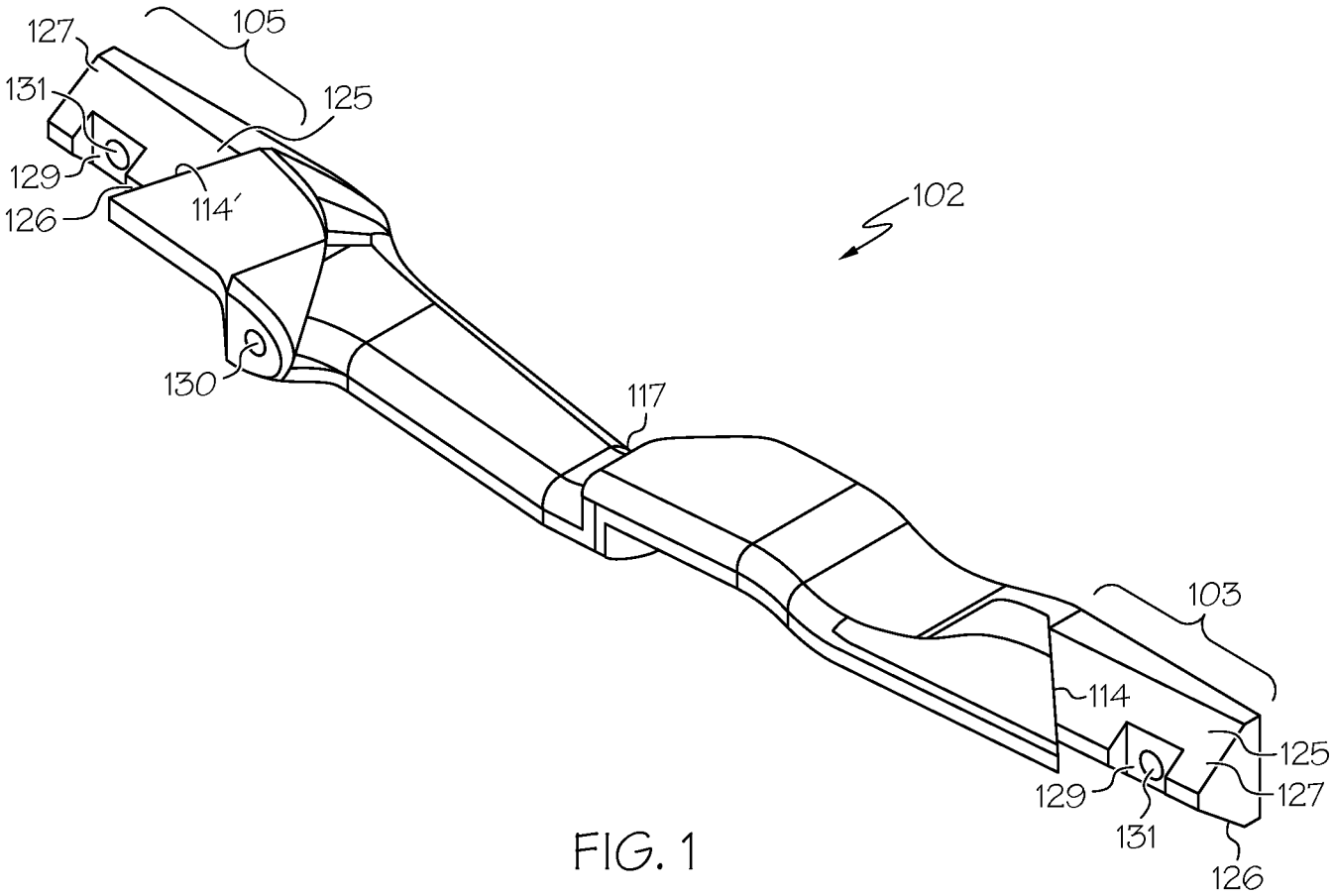
FIG. 1 is a side perspective view of an embodiment of a recurve archery bow riser.

The following detailed description will illustrate the general principles of archery bows that include a first limb releasably connected to a riser by a fastener, where one of the first limb and the riser comprises a first end having a generally V-shaped, elongate mounting section, and the other includes a mounting surface shaped to mate with the generally V-shaped, elongate mounting section. The accompanying drawings provide an example of a recurve archery bow when it is the limb having the generally V-shaped, elongate mounting section and the riser has the mounting surface. It is also understood that the reverse is possible, the limb has the mounting surface and the riser has the generally V-shaped, elongate mounting section, even though this alternate embodiment is not illustrated in the drawings. In the drawings, like reference numbers indicate identical or functionally similar elements.

As used herein "face" means the side of the bow limb nearest the string and "back" means the side of the bow limb opposite the face.

Referring to FIG. 1, an archery bow riser 102 includes a first end 103 and a second end 105 and a handle portion 117 between the first and second ends 103, 105. The first and second ends 103, 105 both include or define a mounting surface 125, but as explained above could instead have the generally V-shaped, elongate mounting section 139 shown on the limb in FIG. 2. The mounting surface 125, regardless of whether it is part of the riser or a limb, is shaped to receive the generally V-shaped, elongate section 139 and as such includes two sloping surfaces 126, 127 generally sloping upwards toward one another in the general orientation of two adjacent lateral faces of a triangular prism and may include an angled receiving wall 114 extending away from the end of the mounting surface 125 most proximate the handle portion 117 and sloped such that the angled receiving walls 114, 114' each extends over a portion of their respective mounting surfaces 125.

Still referring to FIG. 1, the first and second ends 103, 105 each include a female receptacle 129 in their respective mounting surfaces 125. The female receptacles 129 are shown as rectangular cavities, but are not limited thereto. Each mounting surface 125 also defines a bore 131 passing therethrough, which as seen in FIG. 1 may be aligned with the female receptacle 129.

The handle portion 117 may define a connection point 130 for attachment of a stabilizer bar (not shown), and the handle portion 117 may have an ergonomic grip that fits the hand of a user. The riser 102 may be made from wood, polymers, high tensile strength materials such as fiberglass, aramids, carbon, carbon fibers, and combinations thereof.

Figure 2:
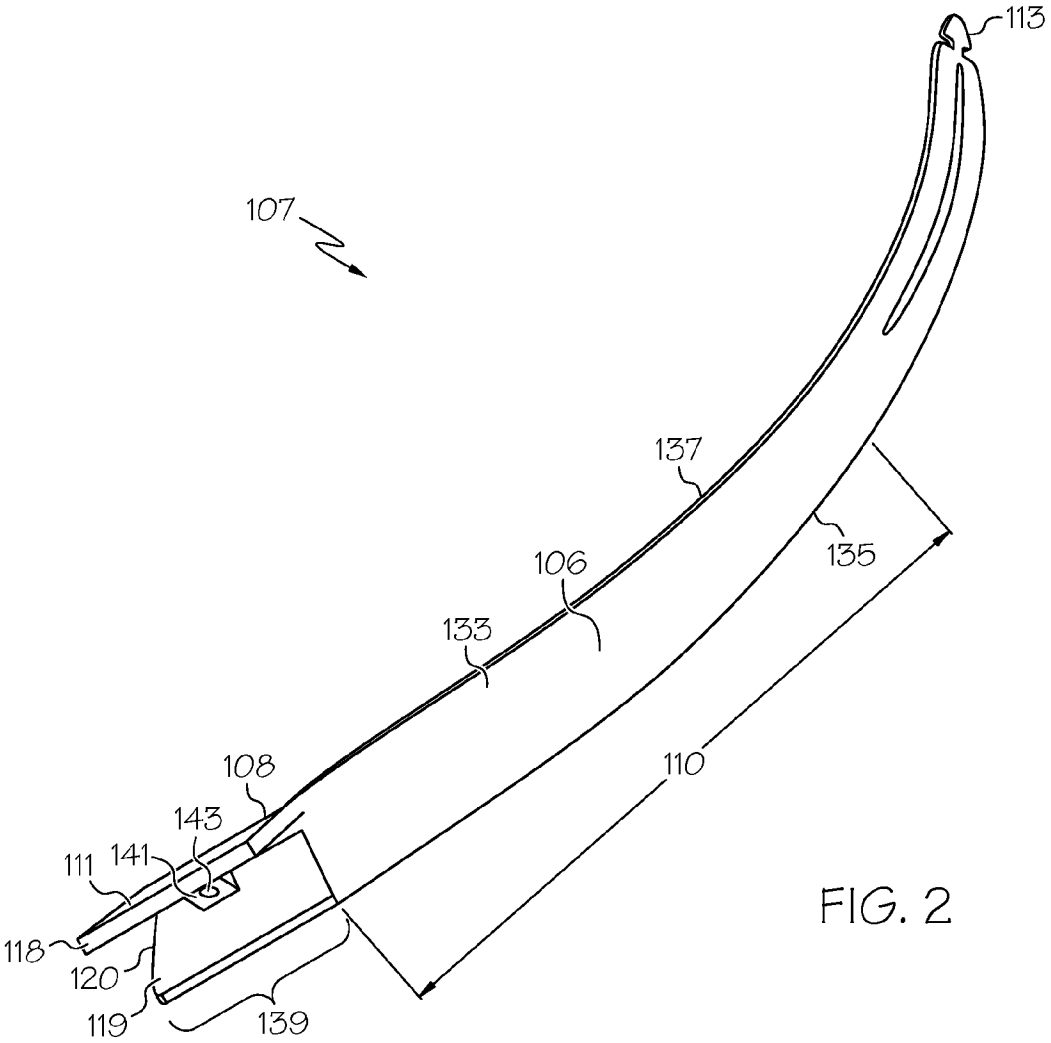
FIG. 2 is a perspective view from the face of an archery bow limb.
Figure 3:
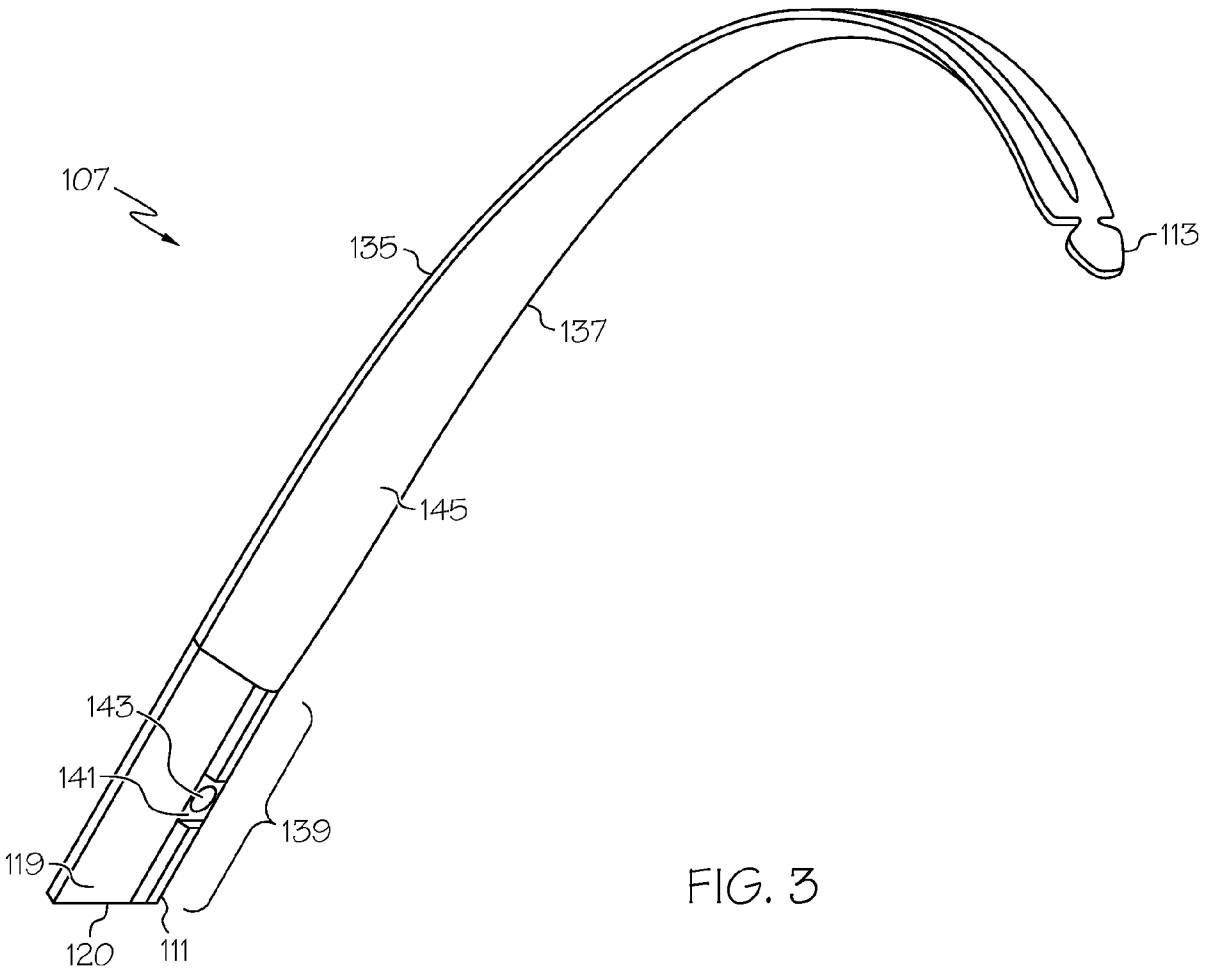
FIG. 3 is a perspective view from the back of the archery bow limb of FIG. 2.

Now referring to FIGS. 2 and 3, archery bow limb 107 includes a proximate end 111, a distal end 113 (or tip), a face 106, a back 108, a center portion 110 and a generally V-shaped, elongate mounting section 139. The mounting section 139 includes a first wall 118 defining one half of the V-shape, a second wall 119 defining the other half of the V-shape, and a beveled end wall 120. The beveled end wall 120 is beveled to facilitate mating with the angled receiving wall 114 of the riser. The mounting section 139 also includes, protruding from the inner surface of the V-shaped, elongate mounting section 139, a male connector 141. The male connector 141 may comprise a rectangular protrusion, but is not limited thereto, and may include an aperture 143 therein. As is expected since the riser and limb are releasably connectable to one another, contour, two sloping surfaces 126, 127 of the mounting surface 125 are shaped to be complimentary to the first wall 118 and the second wall 119 of the generally V-shaped, elongate mounting section 139 of the limb 107.

FIG. 2 presents the face of the limb 107, which has a concave surface 133 beginning proximate the mounting section 139 and gradually transitioning to a generally rectilinear profile proximate to the distal end 113. The arc of the concave surface 133 is defined between the first elongate side 135 and the second elongate side 137 of the limb 107. FIG. 3 presents the back of the limb 107, which has a convex surface 145 beginning proximate to the mounting section 139 and gradually transitioning to a generally rectilinear profile proximate the distal end 113. A description of the transition of the concave and convex surfaces 133, 145 of the limb 107 is presented below after a description of the assembled recurve archery bow 101 in FIG. 4.

Figure 4:
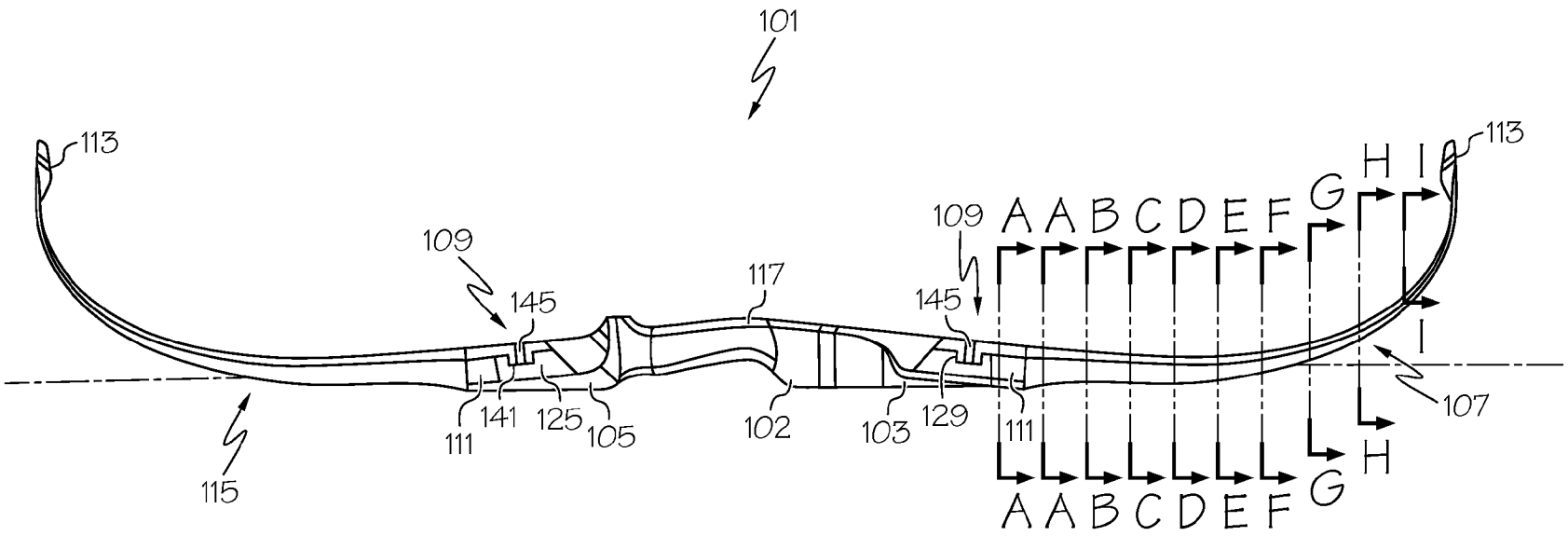
FIG. 4 is an assembled, side view of one embodiment of a recurve archery bow including the riser of FIG. 1 and the limb of FIGS. 2 and 3.
Figure 5:
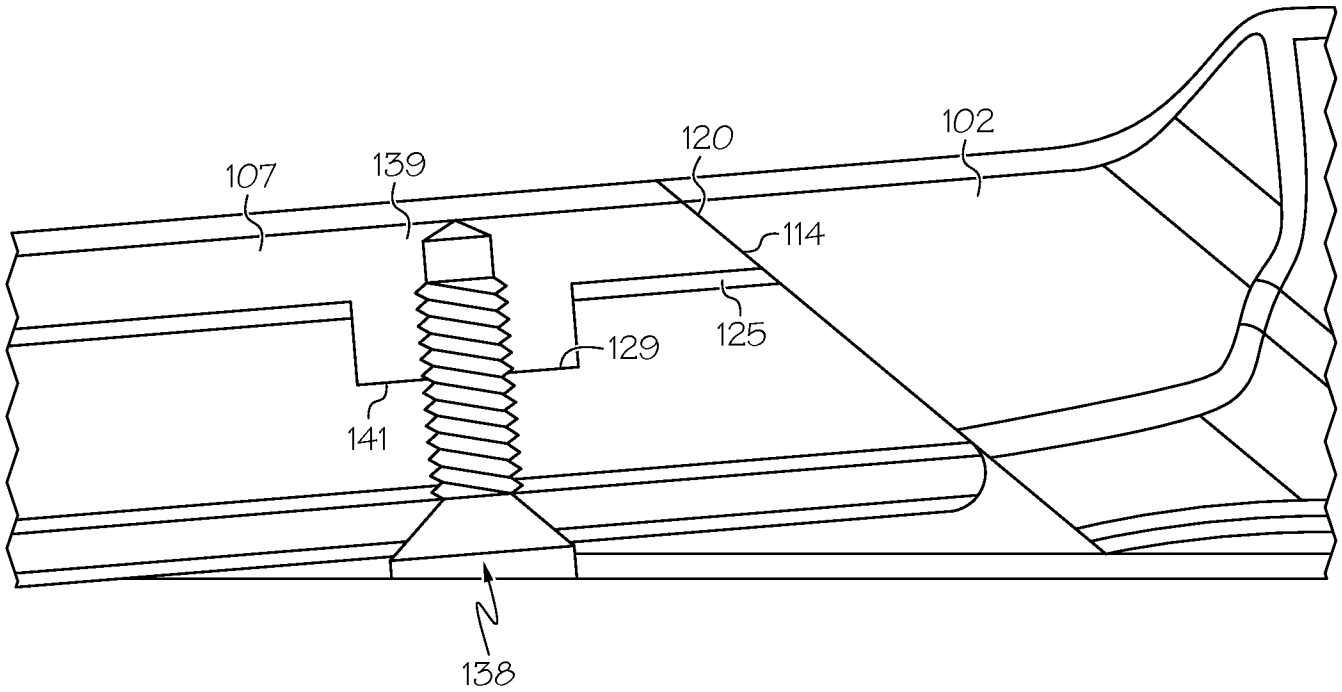
FIG. 5 is an enlarged longitudinal cross-sectional view of the junction of the assembled riser and limb in FIG. 4.

Now referring to FIG. 4, the assembled recurve archery bow, generally designated as 101 and shown as a longitudinal cross-section, has the limb 107 mounted to the first end 103 of the riser 102 and has a second limb 115 mounted to the second end 105 of the riser 102, each of which define a junction 109 with the proximate end 111 of each limb having the male connector 141 seated in the female receptacle 129 of each mounting surface 125. The second limb 115 is generally similar to limb 107 in that it may include a generally V-shaped, elongate mounting section and have concave and convex surfaces as described above. As more clearly shown in the exploded view of the junction 109 of limb 107 and the riser 102 in FIG. 5, the limb 107 has its generally V-shaped, elongate mounting section 139 seated on the mounting surface 125 with the beveled end wall 120 engaged with the angled receiving wall 114 of the riser 102. The limb 107 is also aligned with the riser 102 so that a fastener 138, which may be a screw, bolt, rivet, plug, pin, or other fastener suitable for releasably or fixedly holding the two together, is received in the bore 131 of the riser 102 and in the aperture 143 of the limb 107.

The second limb 115 may be the same or different from limb 107. In one embodiment, the second limb 115 is slightly different than limb 107 in that the beveled end wall (not shown) has a different angle or profile compared to the beveled end wall 120 of limb 107, and accordingly the angled receiving wall 114' in FIG. 1 of the riser 102 matches the change in the beveled end wall of limb 115, so that the limbs 107 and 115 will attach to the riser 102 in only one correct configuration. In an alternate embodiment, the beveled end wall 120 of each limb 107, 115 may be the same and as such provide a universal connection to the angled receiving walls 114, 114' of the riser 102.

FIG. 4 includes lines A through I along the center portion 110 (FIG. 2) of the first limb 107, which are representative of transverse cross-sections for the transverse cross-sectional views illustrated in FIG. 6. As seen by the combination of FIGS. 4 and 6, the V-shape of the generally V-shaped, elongate mounting section 139 of the first limb 107 transitions into the center portion 110 of the face 106 of the first limb 107 as a V-shaped portion 150, as represented in FIG. 6A, having a V-shaped concave face 133 and a V-shaped convex back 145 for the first limb 107. The V-shaped portion 150 may comprise about 0.5 inches to about 6 inches of the length of the limb beginning from the junction of the generally V-shaped, elongate mounting section 139 into the center portion 110 of the limb as represented in FIG. 2. The V-shaped concave face 133 of FIG. 6A gradually, continuously transitions from the concave V-shape to a concave arc 149 as seen in FIG. 6B and similarly the V-shaped concave back 145, which may be about the first four to six inches of the length of the center portion 110, gradually, continuously transitions to a convex arc 155. The concave arc 149 is defined between the first elongate side 135 and the second elongate side 137 of the limb 107 on the face 133 of the limb and gradually, continuously transitions to a generally rectilinear cross-section having a flat surface 151 as illustrated in the progression from FIG. 6B to FIGS. 6H and 6I. Similarly, the convex arc 155 on the opposing side of the limb, the back 145, gradually, continuously transitions to a generally rectilinear cross-section with a flat surface 153 as illustrated in the progression from FIGS. 6B to 6H and 6I.

In one embodiment, the archery bow is a recurve bow and each limb may have a linear length that is about 3 to 6 inches less than the tip-to-tip length of the limb. In one embodiment, each archery bow limb has a tip-to-tip length of about 23 to 26 inches, and a linear length of about 20 to 23 inches. Of the tip-to-tip length, the center portion 110 comprising the concave face 133 and convex back 145 may comprise about 15 to 20 inches thereof. The center portion 110 with the gradually, continuously transitioning concave face 133 and convex back 145 includes various characteristics defining the transition. The first characteristic is the depth D. Each of the cross-sections of FIGS. 6B-6G has a depth D, and the depth D gradually decreases with FIG. 6B having the largest depth D (and being most proximate the V-shaped, elongate mounting section 139) to FIG. 6G having the smallest depth D with each of the cross-sections therebetween being gradually shorter in height than the immediately preceding cross-section. The cross-sections of FIGS. 6H and 6I do not have a depth D because the cross-section no longer has a concave face 133.

A second characteristic that demonstrated the gradual taper of the cross-section in FIGS. 6A to 6I is the arc length lAB. Each of the cross-sections in FIG. 6 has a designated concave arc AB 149 which corresponds to an arc length lAB. The arc length lAB gradually, continuously decreases from the cross-section of FIG. 6B to the cross-section of FIG. 6G as the center portion progresses toward tip 113 and away from the V-shaped, elongate mounting section 139. Accordingly, the cross-section of FIG. 6B has the longest arc length lAB and cross-section FIG. 6G has the shortest arc length lAB with each arc length lAB of each cross-section therebetween gradually becoming shorter than the arc length lAB of the immediately preceding cross-section.

A third characteristic of the center portion 110 of each limb is the width W as labeled in FIG. 6A through FIG. 6I. The width W gradually decreases from the cross-section of FIG. 6B to the cross-section of FIG. 6I as the center portion progresses toward tip 113 and away from the V-shaped elongate mounting section 139. As seen in FIGS. 6B to FIG. 6I the width may change from about 3 inches to about 1 inch over the length of the center portion 110.

Each of the characteristics of each limb described above, i.e., decreasing height, decreasing arc length, and decreasing width, contribute to the ability to use less material while still maintaining the strength of the archery bow 101.

The embodiments of this invention shown in the drawings and described above are exemplary of numerous embodiments that may be made within the scope of the appended claims. It is contemplated that numerous other configurations of the archery bow may be created taking advantage of the disclosed approach. In short, it is the applicant's intention that the scope of the patent issuing herefrom be limited only by the scope of the appended claims.

What is claimed is:

1. An archery bow comprising:

a first limb releasably connected to a riser by a fastener; wherein one of the first limb and the riser comprises a first end having a first generally V-shaped, elongate mounting section, and the other includes a first mounting surface shaped to mate with the first generally V-shaped, elongate mounting section;

wherein the first generally V-shaped, elongate mounting section is mounted to the first mounting surface by the fastener;

wherein whichever of the first limb or the riser has the first mounting surface further comprises an angled receiving wall extending from the end of the first mounting surface most proximate a central portion of the first limb or the riser and sloping toward a distal end of the first mounting surface, and wherein the first generally V-shaped, elongate mounting section further comprises a beveled end wall beveled for mating with the angled receiving wall and is mated thereagainst.

2. The archery bow of claim 1, wherein the generally V-shaped, elongate mounting section includes a male connector protruding from an inner surface thereof, and the mounting surface includes a female receptacle having received therein the male connector.

3. The archery bow of claim 2, wherein the mounting surface defines a bore passing therethrough through the female receptacle; wherein the male connector defines an aperture aligned with the bore in the female receptacle and the fastener is positioned in the bore and the aperture.

4. The archery bow of claim 1, wherein the first limb has a distal end defining a curve thereby rendering the archery bow a recurve archery bow.

5. The archery bow of claim 1, wherein the first limb includes a central portion having a concave face and a convex back.

6. The archery bow of claim 5, wherein the concave face has an arc length measured relative to a transverse cross-section of the limb, and for a plurality of cross-sections of the limb the arc length gradually decreases along the length of the center portion as the cross-sections are taken further from the riser.

7. The archery bow of claim 6, wherein the concave face has a depth measured relative to each transverse cross-section, and for the plurality of cross-sections the depth decreases along the length of the center portion as the cross-sections are taken further from the riser.

8. The archery bow of claim 5, wherein the concave face and convex back gradually, continuously transition from a generally V-shaped portion proximate the riser to a cross-section that is rectilinear shaped distal the riser.

9. An archery bow comprising:

a first limb releasably connected to a riser by a fastener; wherein one of the first limb and the riser comprises a first end having a first generally V-shaped, elongate mounting section, and the other includes a first mounting surface shaped to mate with the first generally V-shaped, elongate mounting section;

wherein the first generally V-shaped, elongate mounting section is mounted to the first mounting surface by the fastener; and a second limb releasably connected to the riser by a fastener; wherein one of the second limb and the riser comprises an end having a second generally V-shaped, elongate mounting section, and the other includes a second mounting surface shaped to mate with the second generally V-shaped, elongate mounting section;

wherein the second generally V-shaped, elongate mounting section is mounted to the second mounting surface by the fastener.

10. The archery bow of claim 9, wherein whichever of the first limb or the riser has the first mounting surface further comprises a first angled receiving wall extending from the end of the first mounting surface most proximate a central portion of the first limb or the riser and sloping toward a distal end of the first mounting surface, and wherein the first generally V-shaped, elongate mounting section further comprises a beveled end wall beveled for mating with the first angled receiving wall and is mated thereagainst.

11. The archery bow of claim 10, wherein whichever of the second limb or the riser has the second mounting surface further comprises a second angled receiving wall extending from the end of the second mounting surface most proximate a central portion of the first limb or the riser and sloping toward a distal end of the second mounting surface, and wherein the second generally V-shaped, elongate mounting section further comprises a beveled end wall beveled for mating with the second angled receiving wall and is mated thereagainst.

12. The archery bow of claim 11, wherein the angle the first angled receiving wall makes relative to the first mounting surface is different than the angle the second angled receiving wall makes relative to the second mounting surface.

13. The archery bow of claim 9, wherein the generally V-shaped, elongate mounting section includes a male connector protruding from an inner surface thereof, and the mounting surface includes a female receptacle having received therein the male connector.

14. The archery bow of claim 13, wherein the mounting surface defines a bore passing therethrough through the female receptacle; wherein the male connector defines an aperture aligned with the bore in the female receptacle and the fastener is positioned in the bore and the aperture.

15. The archery bow of claim 9, wherein the first limb has a distal end defining a curve thereby rendering the archery bow a recurve archery bow.

16. The archery bow of claim 9, wherein the first limb includes a central portion having a concave face and a convex back.

17. The archery bow of claim 16, wherein the concave face has an arc length measured relative to a transverse cross-section of the limb, and for a plurality of cross-sections of the limb the arc length gradually decreases along the length of the center portion as the cross-sections are taken further from the riser.

18. The archery bow of claim 17, wherein the concave face has a depth measured relative to each transverse cross-section, and for the plurality of cross-sections the depth decreases along the length of the center portion as the cross-sections are taken further from the riser.

19. An archery bow kit comprising:

a riser;

at least a first limb releasably connectable to the riser by a first fastener;

a second limb releasably connectable to the riser by a second fastener;

the first fastener; and the second fastener;

wherein one of the first limb and the riser comprises a first end having a first generally V-shaped, elongate mounting section, and the other includes a first mounting surface shaped to mate with the first generally V-shaped, elongate mounting section;

wherein the first generally V-shaped, elongate mounting section is fastenable to the first mounting surface by the fastener;

wherein one of the second limb and the riser comprises an end having a second generally V-shaped, elongate mounting section, and the other includes a second mounting surface shaped to mate with the second generally V-shaped, elongate mounting section;

wherein the second generally V-shaped, elongate mounting section is mounted to the second mounting surface by the fastener.

20. The archery bow kit of claim 19, wherein whichever of the first limb or the riser has the first mounting surface further comprises an angled receiving wall extending from the end of the first mounting surface most proximate a central portion of the first limb or the riser and sloping toward a distal end of the first mounting surface, and wherein the first generally V-shaped, elongate mounting section further comprises a beveled end wall beveled for mating with the angled receiving wall and is mated thereagainst.

* * * * *